United States Patent [19]

Yamamoto

[11] 4,048,774

[45] Sept. 20, 1977

[54] EXTERIOR WINDOW UNIT HAVING ADAPTER SILL MEMBER

[75] Inventor: Yukio Yamamoto, Uozu, Japan

[73] Assignee: Yoshida Kogyo Kabushiki Kaisha, Tokyo, Japan

[21] Appl. No.: 684,888

[22] Filed: May 10, 1976

[30] Foreign Application Priority Data

May 17, 1975 Japan ..... 50-66255

[51] Int. Cl.[2] ..... E06B 3/26

[52] U.S. Cl. ..... 52/202; 49/63; 49/404; 52/211; 160/90

[58] Field of Search ..... 52/79, 127, 202, 204–208, 52/213, 235, 209, 210, 214; 49/501, 504, 103, 409, 410, 411, 404; 160/90, 91

[56] References Cited

U.S. PATENT DOCUMENTS

| | | | |
|---|---|---|---|
| 3,295,277 | 1/1967 | Potter et al. | 49/504 X |
| 3,436,884 | 4/1969 | Bell et al. | 52/202 |
| 3,984,954 | 10/1976 | Takeda | 52/213 X |
| 3,984,955 | 10/1976 | Yamamoto et al. | 52/202 |

*Primary Examiner*—J. Karl Bell

*Attorney, Agent, or Firm*—Hill, Gross, Simpson, Van Santen, Steadman, Chiara & Simpson

[57] ABSTRACT

An exterior window unit is adapted to cover an opening in a building wall. An adapter sill member has a vertical and a horizontal section adapted to be secured, respectively, to an exterior vertical and a horizontal top surface of a fixed sill in the building wall, the adapter sill member having a first engaging means extending along its lower edge. A frame sill of the unit has a mounting means having a vertical and a horizontal portion adapted to be secured, respectively, to the vertical and horizontal sections of the adapter sill member, the frame sill having a second mounting means having a second engaging means which engages the first engaging means.

5 Claims, 4 Drawing Figures

EXTERIOR WINDOW UNIT HAVING ADAPTER SILL MEMBER

BACKGROUND OF THE INVENTION

1. Field of the Invention

This invention relates to a window unit having an adapter sill member for use in combination with a pre-installed sill disposed in an opening in a building wall.

2. Prior Art

The type of exterior window units with which this invention is concerned provides a high degree of thermal insulation, airtightness, and sound insulation since the units are mounted on the outside of openings in building walls, in which openings other window units have been previously installed. The exterior window units of this kind have found extensive use because they can retain the pleasing appearance of the pre-installed window assemblies having paper screen sashes (knon as "Shoji" in Japan). The frame sills of the exterior window units usually include a hollow body of generally rectangular cross section having an upper and a lower portion, and an inner vertical side portion interconnecting the upper and lower portions at their inner ends or edges and having a pair of upper and lower vertical fins formed integrally therewith and extending therefrom one upwardly and the other downwardly, to form a first or vertical mounting portion to be mated with and secured to the exterior vertical surface of the sill of the previously installed window assemblies by screws or other fastening means which pass through the lower vertical fin, the frame sill also including a horizontal flange formed integrally with and projecting inwardly from the upper vertical fin at its top end to form a second or horizontal mounting portion to be mated with and secured to the top horizontal surface of the sill by screws or other fastening means passing through the horizontal flange. When it is desired to install the exterior window units from inside the building walls, it is difficult to fix the first or vertical mounting portion to the exterior vertical surface of the sill because of difficult access to the screw-receiving holes formed through the lower vertical fin extending downwardly of the frame sill body.

It has frequently been desired to increase the height of the upper vertical fins to provide a better weather resistance. Where standard sills having a thickness of from 36mm to 45mm are employed, the first or vertical mounting portion having such an increased upper vertical fin can not be secured directly onto the exterior vertical surface of the sill because the screw-receiving holes formed through the lower vertical fin are located downwardly of the sill when the first or vertical mounting portion is mated with the exterior vertical surface of the sill. One method of overcoming this difficulty has been to interpose an additional wooden plate between the first or vertical mounting portion of the frame sill and the exterior vertical surface of the sill and to fix the first or vertical mounting portion to the exterior vertical surface of the sill by screws passing through the lower vertical fin and the wooden plate. This procedure has been found not entirely satisfactory, hoever, in that it increases the installation costs on account of the use of such added materials. Another alternative has been to provide screw-receiving holes through the lower vertical fin of the first or vertical mounting portion in alignment with the positions of studs in the wall and to fix the first or vertical mounting portion to the exterior vertical surface of the sill by screws passing through the screw-receiving holes into the studs. This approach is also disadvantageous in that it requires a relatively time-consuming operation drill or otherwise process the lower vertical fin to provide such screw-receiving holes at the construction site because the locations of the studs in the walls are not always constant.

SUMMARY OF THE INVENTION

It is therefore an object of this invention to provide an improved exterior window unit wherein a frame sill can be mounted firmly on a fixed sill in a building wall with maximum ease.

Another object is to provide an adapter sill member for use in combination with exterior window units which member will enable frame sills having increased upper vertical fins to be mounted onto standard fixed sills in the building walls.

According to the invention, there is provided an exterior window unit for covering an opening in a building wall which opening has a first sill. The exterior window unit comprises a frame having a second sill. A pair of sashes mounted within the frame in parallel closely spaced planes. An adapter sill member extends along the length of the first sill, and has a vertical section adapted to be secured to an exterior vertical surface of the first sill, and a horizontal section adapted to be secured to a horizontal top surface of the first sill. The vertical section has a first engaging means extending along its lower edge. The second sill has a first mounting means having a vertical portion and a horizontal portion adapted to be secured respectively to the vertical and horizontal sections of the adapter sill member. The second sill also has a second mounting means having a second engaging means engaging the first engaging means.

Many other addvantages and features of the present invention will become manifest to those versed in the art upon making reference to the detailed description and the accompanying sheets of drawings in which preferred structural embodiments incorporating the principles of the present invention are shown by way of example.

DETAILED DESCRIPTION OF THE PREFERRED EMBODIMENTS

Figure 1:
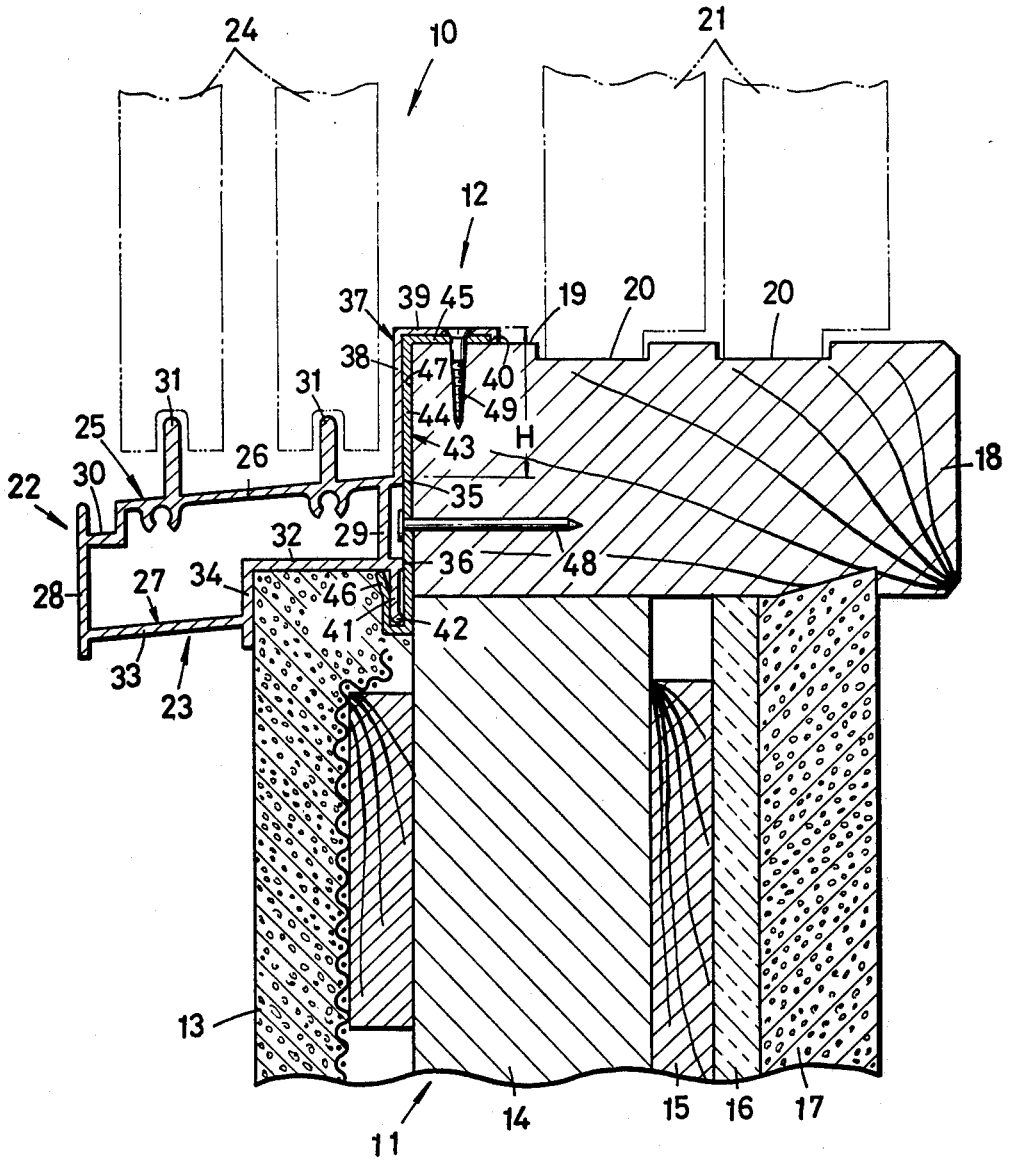
FIG. 1 is a fragmentary vertical cross-sectional view through an exterior window unit having a frame sill and an adapter sill member both of which are provided in accordance with the invention.

FIG. 1 shows an exterior window unit 10 mounted on the exterior of a building wall 11 and covering an opening 12 therein, The building wall 11 includes an exterior siding 13, a stud 14, a batten 15, a thermal insulation board 16 and an interior siding 17. The building wall 11 has a wooden sill 18 having in its top surface 19 a pair of spaced apart, parallel grooves 20, 20 in which the lower edges of a pair of sashes 21, 21 are normally received for horizontal sliding movement, the sill being of a standard type having a vertical thickness of from 36mm to 45mm.

The exterior window unit 10 generally comprises a frame 22 preferably of extruded aluminum and including a sill 23, and a pair of relatively movable sashes 24, 24 of the rolling type mounted within the frame 22 in parallel closely spaced planes. As shown in FIG. 1, the frame sill 23 includes a hollow body 25 of generally rectangular cross section having an upper portion 26, a lower portion 27 and a pair of connecting portions 28 and 29 connecting the upper and lower portions.

The upper portion 26 comprises a plate slanted downwardly outward and stepped as at 30 adjacent to its outer end or edge, the slanted plate having a pair of spaced apart, parallel flanges or rails 31, 31 formed integrally therewith and projecting upwardly therefrom on which the pair of sashes 24, 24 ride for horizontal rolling movement.

The lower portion 27 includes a horizontal plate 32, a second slanted plate 33 extending substantially in parallel relationship to the first-mentioned slanted plate 26, and a vertical plate 34 connecting the horizontal plate 32 and the second slanted plate 33. The second slanted plate 33 is disposed at a level below the horizontal plate 32 to provide a stepped portion for receiving the upper end portion of the exterior siding 13 as shown in FIG. 1.

The connecting portions 29 and 28 comprise respective vertical plates connecting the first slanted plate 26 and the horizontal plate 32 adjacent to their inner ends or edges 35 and 36, and the stepped end portion 30 of the first slanted plate 26 and the second slanted plate 33 at their outer ends or edges.

The frame sill 23 also includes a mounting portion 37 having a vertical plate 38 projecting upwardly from the first slanted plate 26 at its inner end or edge 35 and a horizontal plate 39 formed integrally with and extending inwardly at a right angle from the vertical plate 38, the horizontal plate 39 having its free end directed downwardly substantially at a right angle thereto to provide a longitudinal flange 40 for abutment against the top surface 19 of the sill 18. Both of the vertical and horizontal plates 38 and 39 extend along the entire length of the sill 18.

The horizontal plate 32 has an engaging fin 41 formed integrally therewith and projecting downwardly at a right angle therefrom, the fin 41 being disposed intermediate the inner edge 36 of the horizontal plate 32 and the vertical plate 29. The engaging fin 41 has its free end directed inwardly at an angle thereto to provide an engaging end portion 42.

According to the present invention, an adapter sill member 43 is provided for attaching the frame sill 23 onto the sill 18. The adapter sill member 43 is preferably made of extruded aluminum and extends along the entire length of the sill 18, the adapter sill member being of substantially L-shaped cross section having a vertical plate section 44 and a horizontal plate section 45 extending inwardly at a right angle therefrom. The vertical plate section 44 has its lower marginal end portion formed into a substantially U-shaped hook 46 for snugly receiving the engaging fin 41 therein. The adapter sill member 43 may be replaced by a plurality of plate members each identical in cross section to the adapter sill member 43 but of substantially shorter length which plate members are disposed on the sill 18 in longitudinally spaced relationship.

When the exterior window unit 10 is to be installed, the adapter sill member 43 is first brought into abutment against and secured to the top and exterior vertical surfaces 19 and 47 of the sill 18 by a number of nails 48 passing through the vertical plate section 44 at longitudinally spaced locations along the length thereof. Then, the frame sill 23 is brought into engagement with the adapter sill member 43 with the interior surface of the vertical plate 38, the inner edge 36 of the horizontal plate 32 and the end portion 42 of the engaging fin 41 in abutment against the exterior surface of the vertical plate section 44. The frame sill 23 is then moved downwardly until the undersurface of the horizontal plate 39 is brought into abutment against the upper surface of the horizontal plate section 45, and the engaging fin 41 is snugly received into the hook section 46. In this condition, the edge of the downwardly directed flange 40 is held against the top surface 19 of the sill 18, and the inner edge of the horizontal plate section 45 is against the outwardly facing surface of the flange 40. Finally, a number of screws 49 are threaded through the horizontal plate portion 39 and the horizontal plate section 45 into the sill 18 to connect the frame sill 23 securely to the sill 18.

Figure 2:
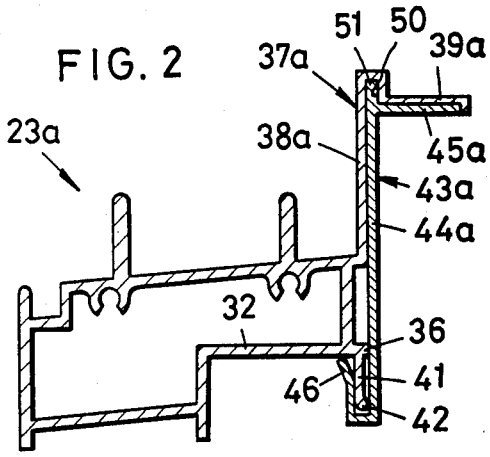
FIG. 2 is a vertical cross-sectional view through modified frame sill and adapter sill member connected together.

According to a modified form of the invention shown in FIG. 2, a mounting portion 37a has its corner portion into which a vertical and a horizontal plate 38a and 39a merge raised along the length thereof so as to provide a channel section 50 of substantially inverted U-shaped cross-section. A vertical plate section 44a of an adapter sill member 43a has its upper end or edge extended beyond the top surface of a horizontal plate section 45a so as to provide an engaging portion 51 which is complementary in shape to the interior of the channel section 50. For installation of the exterior window unit 10, the adapter sill member 43a is secured to the exterior vertical surface 47 of the sill 18 as described above for the number 43. Then, the frame sill 23a is brought into engagement with the adapter sill member 43a as described above for the frame sill 23. The frame sill **23*a* is then moved downwardly until the engaging fin 41 and the engaging portion 51 are snugly received in the hook section 46 and the channel section 50, respectively. The structure 50, 51 obviates the need for the screws 49 of the embodiment shown in FIG. 1**.

Figure 3:
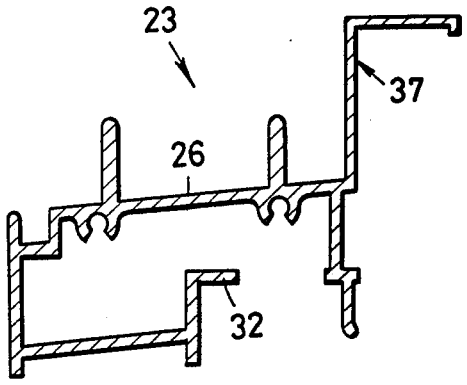
FIGS. 3 and 4 are vertical cross-sectional views through further modified frame sills.

According to another modification, the horizontal plate 32 may be shortened as shown in FIG. 3 to reduce the weight of the frame sill 23.

Figure 4:
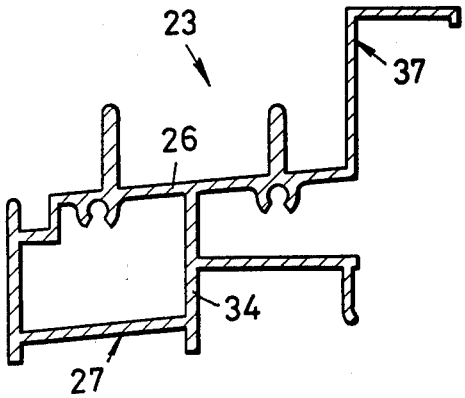

FIG. 4 shows a further modification in which the inner connecting portion is removed, and the vertical plate 34 is extended upwardly in a plane intermediate of the width of the sill body 25 to interconnect the upper and lower portions 26 and 27.

By virtue of the provision of the adapter sill member 43 (**43*a*), the sill 18 being of the standard type having a thickness of from 36mm to 45mm, the height H of the vertical plate portion 38 of the mounting portion 37 can be substantially increased to provide better weather resistance. This is true because the engaging fin 41 extending downwardly of the frame sill body 25 does not need to be fixed directly onto the exterior vertical surface 47 of the sill 18 by screws or similar fastening means, and needs only to be received in the hook section 46**.

Although various minor modifications may be suggested by those versed in the art, it should be understood that I wish to embody within the scope of the patent warranted hereon, all such embodiments as reasonably and properly come with the scope of my contribution to the art.

What is claimed is:

1. An exterior window unit for covering an opening in a building wall, the opening having a first sill, said exterior window unit comprising:

a. a frame having a second sill;

b. a pair of sashes mounted within said frame in parallel closely spaced planes;

c. an adapter sill member for extending along the length of the first sill, said member having a vertical section adapted to be secured flatwise against an exterior vertical surface of the first sill, and a horizontal section extending inwardly from said vertical section at the upper edge thereof and adapted to be secured flatwise against a horizontal top surface of the first sill, said adapter sill member having a marginal portion extending along its lower edge as a channel of upwardly opening U-shaped cross-section facing away from the first sill;

d. a first mounting means on said second sill having a vertical portion and a horizontal portion for being secured respectively to said vertical and said horizontal sections of said adapter sill member, said horizontal portion overlying said horizontal section for being secured directly to said first sill; and e. a second mounting means on said second sill having an engaging means received in said channel.

2. An exterior window unit according to claim 1, said engaging means comprising a downwardly extending fin, said engaging fin being so sized and shaped as to be received in said channel.

3. An exterior window unit according to claim 1, in which said second sill includes a hollow body having an upper portion extending the width of said second sill, a lower portion extending along at least protions of the width of said second sill, an outer vertical side portion connecting said upper and lower portions at their outer edges, and an inner vertical portion offset outwardly from said vertical portion of said vertical mounting means and connecting said upper and lower portions at a point spaced inwardly from said outer vertical side portion.

4. An exterior window unit according to claim 1 in which said vertical section of the adapter sill member has its upper edge extending beyond the top surface of said horizontal section to form an engaging portion, said first mounting means having a portion, into which said vertical and horizontal portions merge, raised longitudinally to provide a channel section of inverted U-shaped cross-section, said engaging portion and the interior of said channel section being complementary in shape to and engaging with each other.

5. An exterior window unit according to claim 3 in which said inner vertical portion connects said upper and lower portions at a point which is central between their inner and outer edges.

* * * * *